US011241890B2

(12) United States Patent
Sonnauer et al.

(10) Patent No.: US 11,241,890 B2
(45) Date of Patent: Feb. 8, 2022

(54) METHOD AND DIRECT-PRINTING MACHINE FOR PRINTING CONTAINERS OF DIFFERENT MATERIAL TYPES IN A DIRECT-PRINTING PROCESS

(71) Applicant: KRONES AG, Neutraubling (DE)

(72) Inventors: Andreas Sonnauer, Neutraubling (DE); August Peutl, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 16/472,858

(22) PCT Filed: Oct. 24, 2017

(86) PCT No.: PCT/EP2017/077090
§ 371 (c)(1),
(2) Date: Jun. 21, 2019

(87) PCT Pub. No.: WO2018/114097
PCT Pub. Date: Jun. 28, 2018

(65) Prior Publication Data

US 2020/0189292 A1 Jun. 18, 2020

(30) Foreign Application Priority Data

Dec. 23, 2016 (DE) ..... 10 2016 226 166.5

(51) Int. Cl.
*B41J 3/00* (2006.01)
*B41J 3/407* (2006.01)
(Continued)

(52) U.S. Cl.
CPC ..... *B41J 3/4073* (2013.01); *B41J 2/175* (2013.01); *B41J 2/1707* (2013.01); *B41J 2/211* (2013.01)

(58) Field of Classification Search
None
See application file for complete search history.

(56) References Cited

U.S. PATENT DOCUMENTS 6,178,886 B1 * 1/2001 Williams ..... B41F 17/22 101/349.1
2003/0007040 A1 1/2003 Love et al.
(Continued)

FOREIGN PATENT DOCUMENTS

DE 102013213843 A1 1/2015
EP 2848414 A1 3/2015
JP 2013215917 A * 10/2013

OTHER PUBLICATIONS

ISA European Patent Office, International Search Report Issued in Application No. PCT/EP2017/077090, dated Jan. 29, 2018, WIPO, 4 pages.

*Primary Examiner* — Erica S Lin
*Assistant Examiner* — Tracey M McMillion
(74) *Attorney, Agent, or Firm* — McCoy Russell LLP

(57) ABSTRACT

A method and a direct-printing machine for printing on containers of different types of materials in a direct-printing process, wherein containers of a first type of material are conveyed by means of a conveyor and printed on, in several layers, with a plurality of printing units by means of direct-printing heads with a first basic ink compatible with the first type of material (102) and, on top of the first basic ink, with at least one colored ink. The first basic ink may be exchanged for a second basic ink, which is compatible with the second type of material, when a change to containers of a second type of material takes place, and the containers of the second type of material may then be printed on, in several layers, with the second basic ink (105) and, on top of the second basic ink, with the at least one colored ink.

14 Claims, 7 Drawing Sheets

(51) Int. Cl.

| | |
|---|---|
| ***B41J 2/17*** | (2006.01) |
| ***B41J 2/175*** | (2006.01) |
| ***B41J 2/21*** | (2006.01) |

(56) References Cited

U.S. PATENT DOCUMENTS

| | | | | |
|---|---|---|---|---|
| 2009/0021542 | A1* | 1/2009 | Kanfoush | B41J 2/185<br>347/6 |
| 2009/0069447 | A1* | 3/2009 | Kitamura | C09D 11/00<br>514/770 |
| 2010/0259576 | A1* | 10/2010 | Mukaiyama | B41J 2/175<br>347/14 |
| 2016/0221708 | A1* | 8/2016 | Ojima | B41J 3/40733 |

* cited by examiner

METHOD AND DIRECT-PRINTING MACHINE FOR PRINTING CONTAINERS OF DIFFERENT MATERIAL TYPES IN A DIRECT-PRINTING PROCESS

CROSS-REFERENCE TO RELATED APPLICATIONS

The present application is a U.S. National Phase of International Patent Application Serial No. PCT/EP2017/077090 entitled "METHOD AND DIRECT-PRINTING MACHINE FOR PRINTING CONTAINERS OF DIFFERENT MATERIAL TYPES IN A DIRECT-PRINTING PROCESS," filed on Oct. 24, 2017. International Patent Application Serial No. PCT/EP2017/077090 claims priority to German Patent Application No. 10 2016 226 166.5 filed on Dec. 23, 2016. The entire contents of each of the above-referenced applications are hereby incorporated by reference for all purposes.

TECHNICAL FIELD

The present invention relates to a method and a direct-printing machine for printing on containers of different types of materials in a direct-printing process.

BACKGROUND AND SUMMARY

In container labeling processes, direct-printing processes, in which the containers are printed on directly with direct-printing heads, are now increasingly used, alternatively or additionally to the known labeling machines. Such a direct-printing head may work e.g. according to the ink jet printing method, in the case of which individual ink droplets are applied to a container by means of a plurality of printing nozzles. The printing nozzles are normally arranged in one or a plurality of parallel rows of nozzles and can be controlled individually. For areal printing, the containers are rotated relative to the direct-printing head e.g. by means of container holders, so that an areal print image consisting of a printing ink is created.

For this purpose, the container is usually first printed on with a basic ink, which is compatible with its type of material, and, subsequently, with additional colored inks. To this end, a conveyor has arranged thereat a plurality of direct-printing heads, which apply individual print images consisting of the basic ink and of a plurality of colored inks to the circumference of the container (e.g. a basic ink white and the colored inks cyan, magenta, yellow and black). The print images then combine to form the multicolor direct print.

This is disadvantageous insofar as, in the case of a change to containers of a different type of material, both the basic ink and the colored inks have to be exchanged, since ink systems for different types of materials are usually not chemically and physically compatible with each other. This requires a correspondingly great effort when retooling the direct-printing machine for the containers of the different type of material.

Therefore, it is the object of the present invention to provide a method and a direct-printing machine for printing on containers, which consist of different types of materials, in a direct-printing process, in the case of which the change to a container consisting of a different type of material requires less effort.

For solving this posed task, the present invention provides the method for printing on containers of different types of materials in a direct-printing process.

Due to the fact that, when changing to containers of the second type of material, the first basic ink is exchanged for a second basic ink, which is compatible with the second type of material, a mixing of the basic inks in the printing unit will not have any negative effect on their chemical and physical stability. Hence, the first basic ink need not be fully removed from the printing unit, so as to allow a change to the second basic ink. It follows that flushing operations of the printing unit, which are necessary in the case of a change, can be reduced or avoided completely. When the first and second basic inks are compatible with each other, a change of the colored inks will not be necessary either, since these inks adhere to both basic inks. As a result, the printing units with the colored inks need not be changed either. Taking all this into account, a substantially reduced set-up time will thus be obtained, when changing to the containers of the second type of material.

The method can be carried out with a direct-printing machine for printing on containers in a beverage processing plant. The direct-printing machine may be located downstream of a filling plant, which is used for filling a product into the containers, and/or a capper. The direct-printing machine may, however, also be located upstream of the filling process and/or directly downstream of a container manufacturing process. The method can be executed in a control unit of the direct-printing machine, which controls the printing units and the direct-printing heads.

The containers may be provided for accommodating therein beverages, hygiene articles, pastes, chemical, biological and/or pharmaceutical products. In general, the containers may be provided for any flowable or fillable media. The first and/or second type of material of the containers may be plastic, glass or metal, but hybrid containers with mixed types of materials are imaginable as well. In the case of plastic containers, the first and/or second type of material may be PET, HDPE or PP. In addition, the type of material may be a biodegradable material, such as corn starch. Preferably, the first and the second type of material may be different from one another. The containers may be bottles, cans and/or tubes. The containers may be rotationally symmetrical in cross-section and/or specially shaped containers with at least one surface deviating from the rotational symmetry around the longitudinal axis of the container. The specially shaped containers may comprise at least one relief-like surface area.

The conveyor may comprise a carousel or a conveyor belt. While the process is taking place, the container may be rotated by means of a container holder at the conveyor preferably about its longitudinal axis, so as to produce an areal print image through the rotary movement. During the process, the containers may be supplied to individual printing units by means of the conveyor, each of the printing units comprising one or a plurality of direct-printing heads. It is imaginable that conveyance of the containers is stopped or continued without any interruption during a printing process. The printing units may be arranged stationarily along the conveyor configured as a carousel. Alternatively, the printing units may be configured such that they rotate at and together with the conveyor, which is configured as a carousel, each container holder having here preferably associated therewith a printing unit.

The printing units may each comprise one or a plurality of direct-printing heads and an ink feed unit for the first basic ink or for one of the at least one colored inks.

The direct-printing head may work with a digital or ink jet printing process, in the case of which the printing ink is transferred to the containers by means of the printing nozzles. "Ink jet printing process" may here mean that in chambers of a printing nozzle a sudden pressure rise is produced via piezo elements or thermocouples, so that a small amount of ink will be pressed through the printing nozzles and transferred to the container as a print drop. Each printing nozzle may be configured for producing a print dot on the container. The direct-printing head may comprise a nozzle plate having at least one row of nozzles comprising the printing nozzles. A row of nozzles may have a number of printing nozzles in a range of 100-10000, in particular in a range of 250-1024. Likewise, it is imaginable that the nozzle plate comprises a plurality of rows of nozzles (e.g. 1-8), which are arranged in parallel.

The ink feed unit may comprise one or a plurality of ink pumps and/or one or a plurality of ink reservoirs. The respective ink reservoirs may be provided for the first or the second basic ink or for one of the colored inks. The ink pumps may be provided for supplying one or a plurality of direct-printing heads with ink. Preferably, the ink is pumped from the ink reservoir to the direct-printing head, through the latter and then back into the ink reservoir. This results in an ink circuit so that the respective ink keeps moving and will adhere neither to the inner side of the fluid line nor to the interior of the direct-printing head.

"That the containers of the second type of material are then printed on, in several layers, with the second basic ink and, on top of the second basic ink, with the at least one colored ink" may here mean that the containers of the second type of material are printed on with the same colored inks as the containers of the first type of material. "In several layers" may mean that a layer comprising at least one of the colored inks is printed onto a layer comprising the basic ink.

The basic ink may comprise a white color and/or a white primer. The colored inks may comprise the colors cyan, magenta, yellow or black. Likewise, special colors, e.g. a metallic silvery color, are imaginable. The basic ink and/or the colored inks may be UV-curable printing inks. Preferably, the basic ink and/or the colored inks may be cured by means of a pinning station and/or a curing station with UV light. "Basic ink" may here mean that this is a printing ink, which can be printed directly onto a non-treated surface of the container and which adheres particularly well to the type of material that is compatible therewith. "Colored ink" may here mean that this is a printing ink, which can be printed onto the basic ink or one of the other colored inks and which adheres particularly well to the container areas that have already been printed on with these inks. That the basic ink is compatible with a specific type of material may here mean that it adheres to a surface of a container consisting of this specific type of material and wets this surface (i.e. does not run on it, for example). "In several layers" may here mean that the lowermost layer is formed by the basic ink and that one or a plurality of color layers consisting of the colored ink are positioned on top of this lowermost layer.

In addition, the method may comprise a further change to containers of the first type of material or of a third type of material, in the case of which the second basic ink is exchanged for the first basic ink or a third basic ink, which is compatible with the third type of material, and the containers of the first type of material or of the third type of material are subsequently printed on, in several layers, with the first or the third basic ink and, on top of these inks, with the at least one colored ink.

It goes without saying that the features referred to hereinafter will apply in a corresponding manner also to a change back to the containers of the first type of material and to the further change to the containers of the third type of material.

The second basic ink may be chemically and physically compatible with the first basic ink such that both basic inks can be mixed completely into one another, without any destabilization of the two basic inks being caused. This allows the printing unit and in particular the ink feed unit to be flushed with the second basic ink, the second basic ink mixing homogeneously with the first basic ink in the course of this process. Preferably, the second basic ink may be chemically and physically compatible with the first basic ink such that both basic inks can be mixed so as to form a single phase, and, as a result, in particular accumulations of color particles and/or color particles of increased size will be avoided. Additionally or alternatively, the second basic ink may be chemically and physically compatible with the first basic ink such that the two basic inks can be mixed to form a color mixture that it stable over a period of at least one day, preferably of at least one month, without in particular a viscosity and/or a particle size distribution of the colour mixture undergoing a significant change during this period. Preferably, the first basic ink and the second basic ink may have a substantially identical surface tension. In addition, the first and the second basic ink may have the same or a similar polarity. That the second basic ink is chemically compatible with the first basic ink may here mean that the first and second basic inks and/or their components will not chemically react with each other.

One of the printing units may be configured for printing the first and second basic inks with at least one direct-printing head, and an ink feed unit may supply the at least one direct-printing head selectively with the first or the second basic ink for the purpose of printing. As a result, it will suffice to switch over only the ink feed unit in the printing unit, when changing to the containers of the second type of material. A changeover can thus be carried out particularly fast and with little effort.

During a change, the at least one direct-printing head and/or the ink feed unit with the first basic ink may be emptied at least partially, preferably flushed at least once and filled with the second basic ink. The ink feed unit may thus be provided with a particularly simple structural design. It is imaginable that the ink feed unit comprises a supply line for the first basic ink as well as one for the second basic ink. Switching over of the ink feed unit can thus take place in an automated fashion. It is imaginable that a common reservoir and a common supply section, which are suitably emptied, flushed and filled, are used for the ink feed unit. Likewise, it is imaginable that separate reservoirs for the first and second basic inks are provided in the case of the ink feed unit, the reservoirs being connected to the at least one direct-printing head via a switchable supply section. Accordingly, only the parts of the supply section used for both basic inks will then be emptied, flushed and filled with the second basic ink. It follows that, during flushing, the at least one direct-printing head and/or a common supply section for both basic inks may be flushed. It is imaginable that the ink feed unit comprises an ink circuit with an incoming flow line and a return flow line leading to and away from the at least one direct-printing head, the ink circuit being then suitably emptied, preferably flushed at least once and filled with the second basic ink.

The at least one direct-printing head and/or the ink feed unit may be filled at least once with the second basic ink during flushing, so that the first basic ink remaining therein after emptying will mix with the second basic ink. This means that it will not be necessary to use a specific flushing solution for the purpose of flushing, so that the structural design of the ink feed unit can be simplified. For example, the first basic ink may be emptied from the at least one direct-printing head and/or from the ink feed unit as far as possible, whereupon the at least one direct-printing head and/or the ink feed unit may be flushed with the second basic ink. As a result, a first mixture is obtained, which comprises e.g. 20% of the first basic ink and 80% of the second basic ink. Subsequently, also the first mixture is discharged and flushing with the second basic ink is again carried out. This results in a second mixture of both basic inks, the percentage of the first basic ink being now as low as 4% and that of the second basic ink being 96%. The second mixture can then either already be used for printing, or flushing with the second basic ink may again be carried out. This results in a maximum residual amount of the first basic ink in the mixture of less than 1%.

During printing, the at least one direct-printing head can selectively be supplied from a first ink supply with the first basic ink or from a second ink supply with the second basic ink by means of the ink feed unit, and the ink feed unit can switch from the first ink supply to the second ink supply during the change. This allows a particularly fast and automated switching over from the first basic ink to the second basic ink during the change. The first ink supply and/or the second ink supply may each comprise a reservoir with the first basic ink and the second basic ink, respectively. Preferably, the ink feed unit may comprise a directional valve for switching over from the first ink supply to the second ink supply. It is also imaginable that, during printing, the at least one direct-printing head is supplied by means of the ink feed unit selectively from the first ink supply, from the second ink supply and from at least one further ink supply with at least one further basic ink. In this way, even more different types of materials of the containers can be printed on making use of the present method.

The ink feed unit may mix a basic component selectively with a first or a second additive so as to form therefrom either the first or the second basic ink, and, during the change, the ink feed unit switches over from mixing the basic component with the first additive to mixing the basic component with the second additive. In other words, the first basic ink and the second basic ink can be mixed by the printing unit selectively from the basic component and the first additive or the second additive. This will reduce ink losses during a change.

The ink feed unit may obtain the basic component, the first and the second additive from respective different supplies. For example, the ink feed unit comprises respective different supplies for the basic component, the first and the second additive, the different supplies being connected to the at least one direct-printing head via respective supply sections and a mixer for mixing the basic component with the first or the second additive.

During a change, switching over from one of the printing units for printing the first basic ink to another printing unit for printing the second basic ink, or an exchange of these printing units, may be carried out. If, for example, separate printing units are provided for the first and the second basic ink, the change can take place during operation, since it will suffice to activate the respective other printing unit. It is also imaginable to exchange at the printing machine the printing unit with the first basic ink for a printing unit with the second basic ink.

The present invention additionally provides a direct-printing machine used for printing a direct print onto containers of different types of materials.

Due to the fact that one of the printing units is configured such that it can be switched over for printing at least two different basic inks, depending on the type of material of the containers, or a plurality of printing units for printing respective different basic inks are provided, which, depending on the type of material of the containers, are configured such that they can be switched over or exchanged for one another, containers can, depending on the type of material, be printed on with the respective basic ink compatible therewith. This leads to a substantially reduced set-up time, when changing between containers of different types of material.

The direct-printing machine for printing on containers may be arranged in a beverage processing plant. The conveyor may be configured as a carousel comprising container holders, which are arranged on the circumference thereof. The container holders may comprise a rotary table and/or a centering bell. The printing units may be arranged stationarily at the periphery of the carousel. It is also imaginable that a respective printing station is arranged at each of the container holders, each of the printing stations comprising a plurality of printing units for printing the basic ink and the colored inks onto the containers in several layers.

It is imaginable that the ink feed unit comprises an ink circuit which has an incoming flow line and a return flow line leading to and away from the at least one direct-printing head and by means of which the basic ink can be circulated continuously during operation.

One of the printing units may be configured for printing a first and a second basic ink by means of at least one direct-printing head, and an ink feed unit may be configured for supplying the at least one direct-printing head selectively with the first or the second basic ink. This allows a particularly cost-effective structural design of the printing unit for the first and second basic inks. The ink feed unit may comprise a first reservoir for the first basic ink and a second reservoir for the second basic ink. Both reservoirs may be connected to the at least one direct-printing head via a switching element. The switching element may be configured to switch over between the supply with the first basic ink and the second basic ink. For example, the switching element may comprise a three-way valve. It is also imaginable that the printing unit for printing the first and the second basic ink is additionally configured for printing at least one third basic ink by means of the at least one direct-printing head, and the ink feed unit may be configured for supplying the at least one direct-printing head selectively with the first, the second or the at least one third basic ink.

The ink feed unit may be configured for mixing a basic component selectively with a first additive or a second additive, so as to form therefrom either the first or the second basic ink, and the ink feed unit is configured such that, for a change of the type of material of the containers, it can be switched over from mixing the basic component with the first additive to mixing the basic component with the second additive. Since the basic component can be used for both basic inks, ink losses during a change of the basic ink can be reduced in this way.

One of the printing units for printing a first basic ink for containers of a first type of material may be configured such that it can be exchanged for another one of the printing units for printing a second basic ink for containers of a second type of material. This allows a particularly fast exchange of the first basic ink for the second basic ink.

The at least two different basic inks may be chemically and physically compatible with one another such that they can be mixed so as to form a single phase, thus avoiding especially accumulations of color particles and/or color particles of increased size. This allows the printing unit and in particular the ink supply system to be flushed with the second basic ink, the second basic ink mixing homogeneously with the first basic ink in the course of this process. Preferably, the two different basic inks may have a substantially identical surface tension. In addition, the two different basic inks may have the same or a similar polarity. That the two different basic inks are chemically compatible may here mean that the two basic inks and/or their components do not chemically react with each other.

The direct-printing machine may comprise, individually or in arbitrary combinations, the features described above with respect to the method.

BRIEF DESCRIPTION OF THE FIGURES

Additional features and advantages of the present invention will be explained hereinafter in more detail with reference to the embodiments shown in the figures, in which.

DETAILED DESCRIPTION

Figure 1:
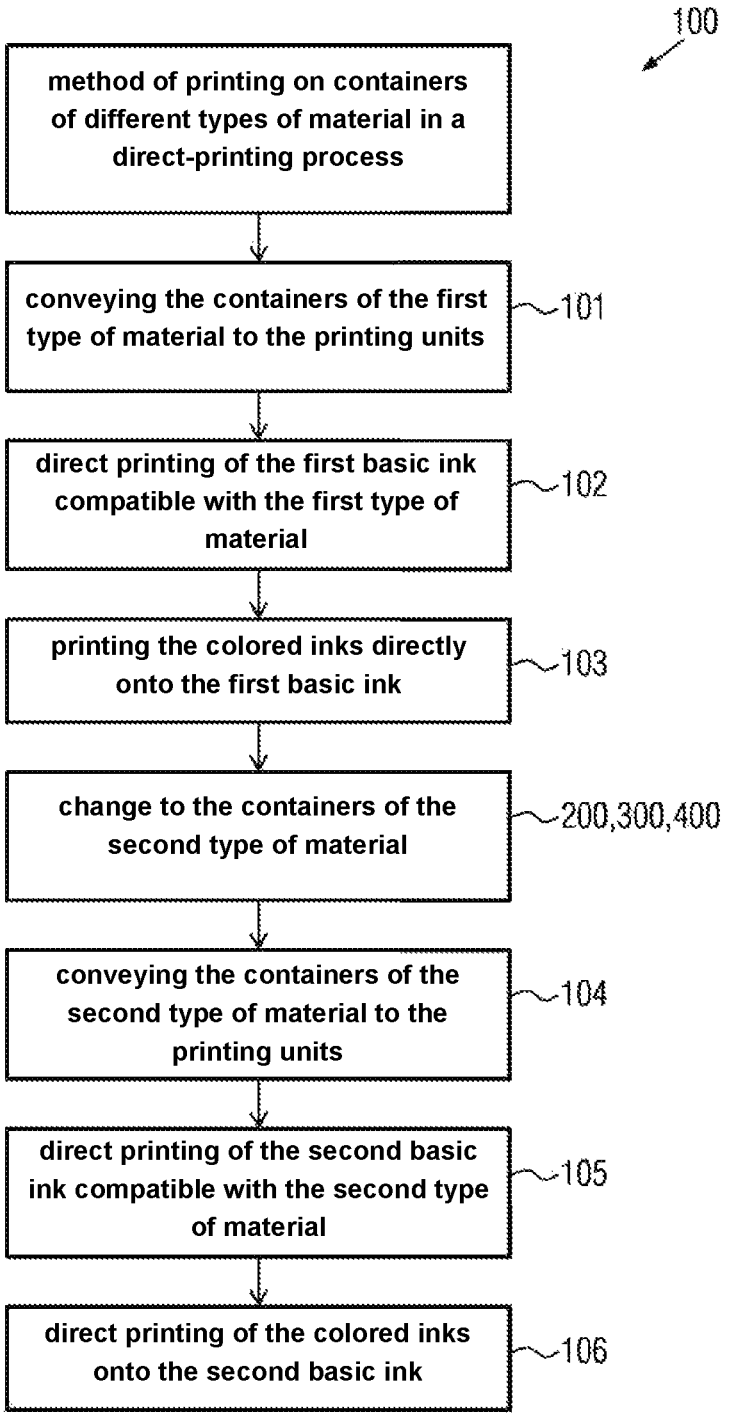
FIG. 1 shows, as a flowchart, an embodiment of a method according to the present invention used for printing on containers of different types of materials in a direct-printing process.

FIG. 1 shows, as a flowchart, an embodiment of a method 100 according to the present invention used for printing on containers of different types of materials in a direct-printing process.

What can be seen is that containers of the first type of material are conveyed to the printing units in step 101. The printing units may here be arranged stationarily at a conveyor, the containers being conveyed to and away from the individual printing units during conveyance. It is also imaginable that a conveyor, e.g. a carousel, has arranged thereon container holders which each have a printing station, each of these printing stations comprising a plurality of printing units for printing at least one basic ink and at least one colored ink.

In step 102, the containers of the first type of material are then printed on with a first basic ink, which is compatible therewith, in a direct-printing process. The first basic ink is here of such a physical and chemical nature that it will adhere particularly well to the first type of material. The containers in question are made e.g. of HDPE. In addition, the first basic ink is white in color, so that the colored inks printed on in the subsequent step 103 will appear as brilliant as possible.

In step 103, the containers of the first type of material are then printed on, again in a direct-printing process, with a plurality of colored inks, such as cyan, magenta, yellow and black. Special colors are, however, imaginable as well. In steps 102 and 103, the printing inks are printed on, one on top of the other in several layers, so that finally a multi-color direct print will be created.

Direct-printing process means here that the containers are printed on with direct-printing heads that work according to a digital or ink jet printing process. Preferably, each of the direct-printing heads comprises four rows of nozzles with e.g. 1024 printing nozzles. However, also any other suitable configuration of the printing nozzles is imaginable.

When the containers of the first type of material have been finished, a change to the containers of the second type of material will take place in steps 200, 300 or 400. These steps will be explained hereinafter in more detail making reference to FIGS. 2, 3 and 4. When a change to the containers of the second type of material takes place, the first basic ink is replaced by a second basic ink which is compatible with the second type of material. The second basic ink is chemically and physically compatible with the first basic ink such that both basic inks can be mixed so as to form a single phase, so that neither accumulations of color particles nor color particles of increased size will be caused. A change is thus substantially simplified, since there is no need for removing the first basic ink completely from the respective printing unit.

After the change, the containers of the second type of material are conveyed, according to the above described step 101, to the printing units in step 104. There, the containers are first printed on with the second basic ink compatible with the second type of material in step 105, in a manner similar to step 102, but with the second basic ink instead of the first basic ink. Subsequently, the containers of the second type of material are printed on in step 106 with the same colored inks as in step 103. In other words, there is no change of colored inks, since the latter are also compatible with the second basic ink and adhere to it.

Subsequently, the method allows changing back to the containers of the first type of material, i.e. a change to the first basic ink takes place, or changing to a further type of material and to a further basic ink compatible with the further type of material.

Figure 2:
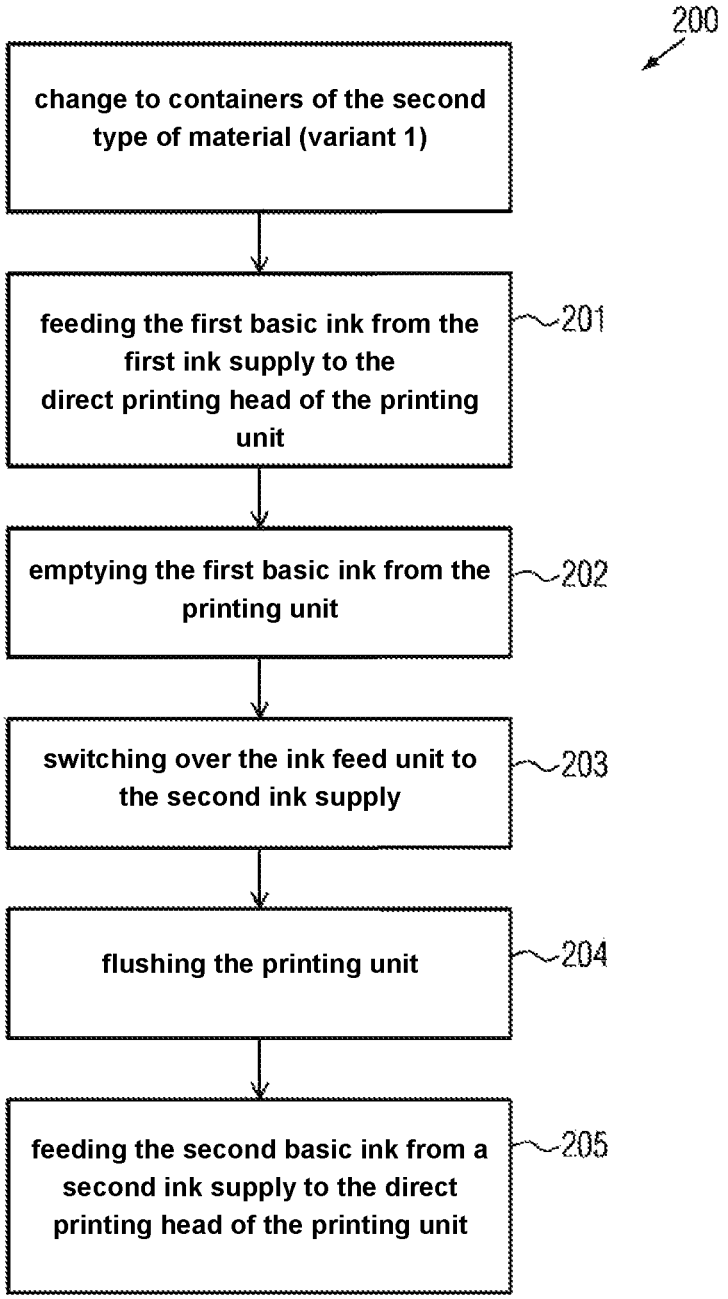
FIG. 2 shows substeps of the method according to FIG. 1 for changing to the containers of the second type of material according to a first variant.

FIG. 2 shows, as a flowchart, the substeps of the method 100 according to FIG. 1 for changing to the containers of the second type of material according to a first variant 200.

First, the direct printing head of the printing unit has fed thereto the first basic ink from a first ink supply in step 201. The first ink supply may e.g. comprise a reservoir from which the first basic ink is pumped to the direct-printing head by means of the ink feed unit. This is done during the above-described step 102.

Upon changing to the second basic ink, the first basic ink is then first emptied from the printing unit in step 202. This is done from all supply sections and lines into which the second basic ink will be filled subsequently. For example, emptying takes place into a waste container or the like.

Following this, the ink feed unit is switched over to the second ink supply in step 203. This is done e.g. by means of a directional valve or some other suitable unit. Also the second ink supply may comprise a reservoir from which the second basic ink is pumped to the direct-printing head by means of the ink feed unit.

In addition, the printing unit is flushed in step 204. In so doing, all the supply sections of the ink feed unit, which are used by the first and the second basic ink in common, are flushed. It will be advisable to execute flushing with the second basic ink, since the latter is chemically and physically compatible with the first basic ink. For example, when the emptying step 202 is carried out, 20% of the first basic ink still remain in the printing unit. It follows that, during flushing, the remaining 80% will be filled with the second basic ink. When the two basic inks have been mixed, the mixture is emptied once more and refilling with the second basic ink takes place. Subsequently, the percentage of first basic ink in the mixture will only be 4%. The steps of emptying and refilling with the second basic ink are continued until the residual amount of the first basic ink falls below a desired percentage of the total mixture.

Subsequently, the direct-printing head of the printing unit has fed thereto the second basic ink from the second ink supply in step 205. This is done during the above-described step 105, so as to print the second basic ink onto the containers of the second type of material.

Figure 3:
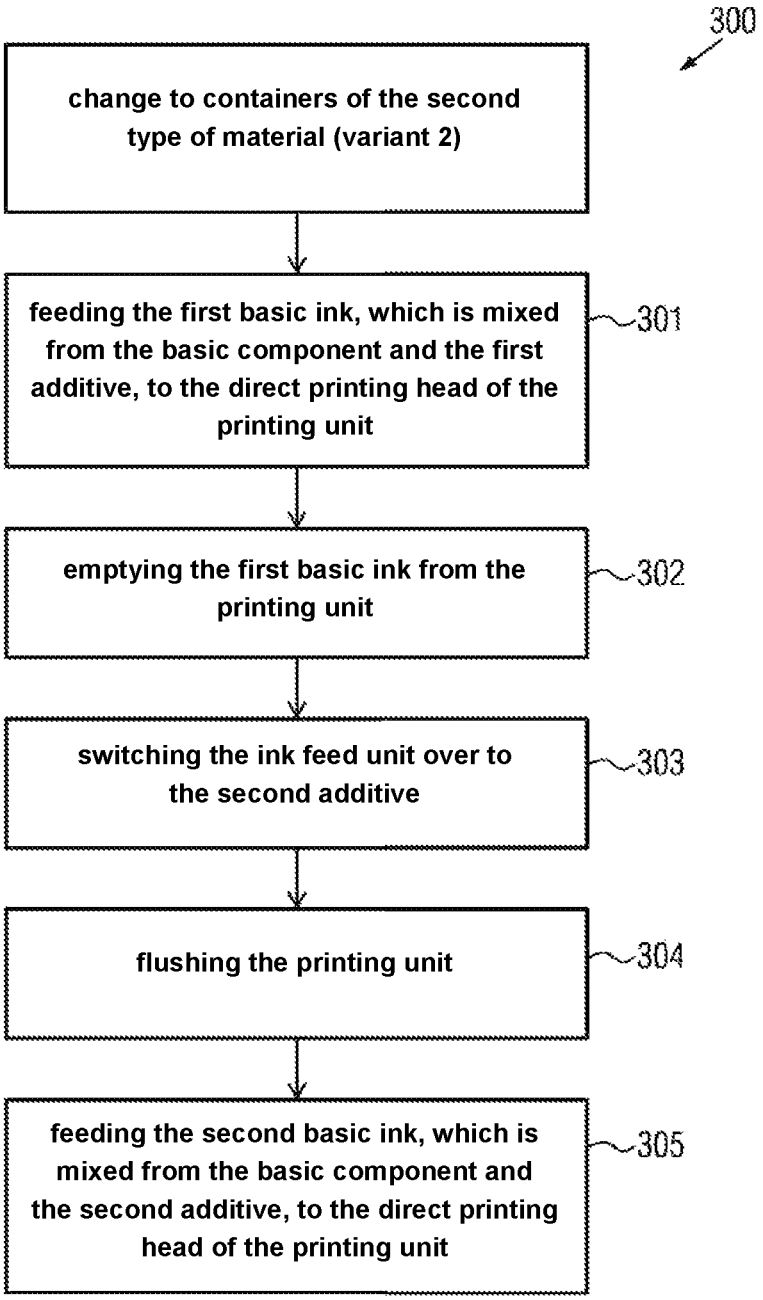
FIG. 3 shows substeps of the method according to FIG. 1 for changing to the containers of the second type of material according to a second variant.

FIG. 3 shows, as a flowchart, the substeps of the method 100 according to FIG. 1 for changing to the containers of the second type of material according to a second variant 300.

This differs from the first variant 200 essentially insofar as, at the printing unit, the first basic ink is mixed from a basic component and a first additive and the second basic ink is mixed from the same basic component and a second additive.

First, the direct-printing head has fed thereto the first basic ink (during the above described step 102) in step 301, the first basic ink being mixed from the basic component and the first additive. The basic component is e.g. a carrier liquid that can be used for both the first and the second basic ink. The basic component is taken from a suitable supply and the first additive from a further supply via suitable supply sections of the ink feed unit, whereupon they are mixed with each other and fed to the direct-printing head.

Upon changing to the containers of the second type of material, the first basic ink is first emptied, in step 302, from the printing unit, in particular from the supply sections, which will subsequently also be used with the second basic ink.

Following this, the ink feed unit is switched over to the second additive in step 303. Similar to step 301, the basic component is then mixed with the second additive and fed to the direct-printing head. In so doing, the second additive is taken from a further supply.

In the subsequent step 304, the printing unit is then flushed with the second basic ink, i.e. with a mixture of the basic component and the second additive. This is done in a similar way as described above in step 204. Also in this case, the printing unit can be emptied more than once and refilled with the second basic ink consisting of the mixture of the basic component and of the second additive.

In the further step 305, the direct-printing head of the printing unit has then fed thereto the second basic ink, which is mixed from the basic component and the second additive (during the above described step 105).

Figure 4:
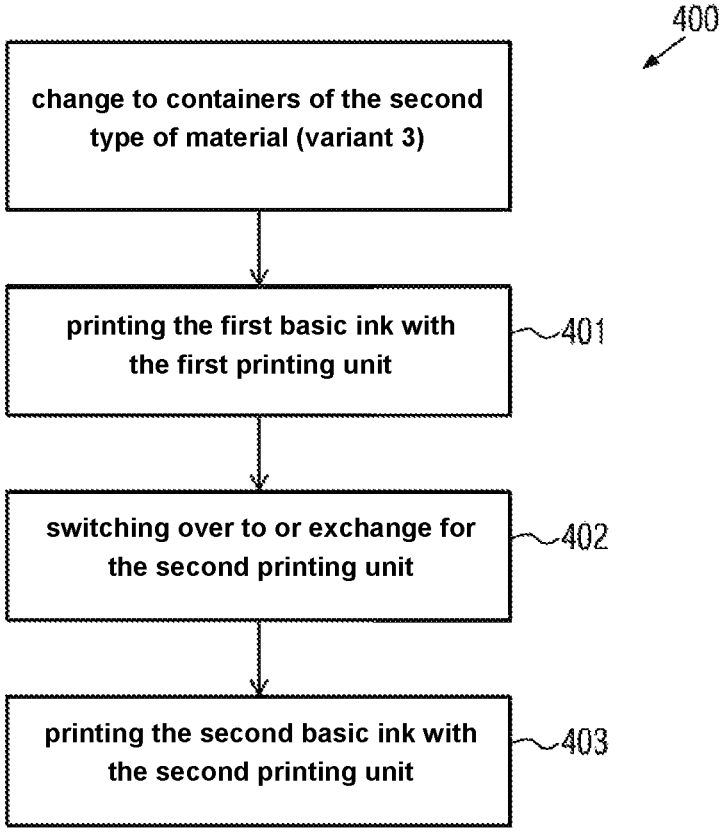
FIG. 4 shows substeps of the method according to FIG. 1 for changing to the containers of the second type of material according to a third variant.

FIG. 4, shows, as a flowchart, the substeps of the method 100 according to FIG. 1 for changing to the containers of the second type of material according to a third variant 400.

This differs from the above described variants 200 and 300 insofar as the printing unit used here for printing the second basic ink differs from that used for the first basic ink. First, in step 401, the first basic ink is printed with a first printing unit, as described in the above described step 102.

When, subsequently, containers of the second type of material are to be printed on, step 402 will either switch over to a second printing unit, which is already arranged at the printing position, or the first printing unit will be exchanged for the second printing unit at the same printing position.

Subsequently, printing the second basic ink by means of the second printing unit, as described above in step 105, is started in step 403.

Figure 5:
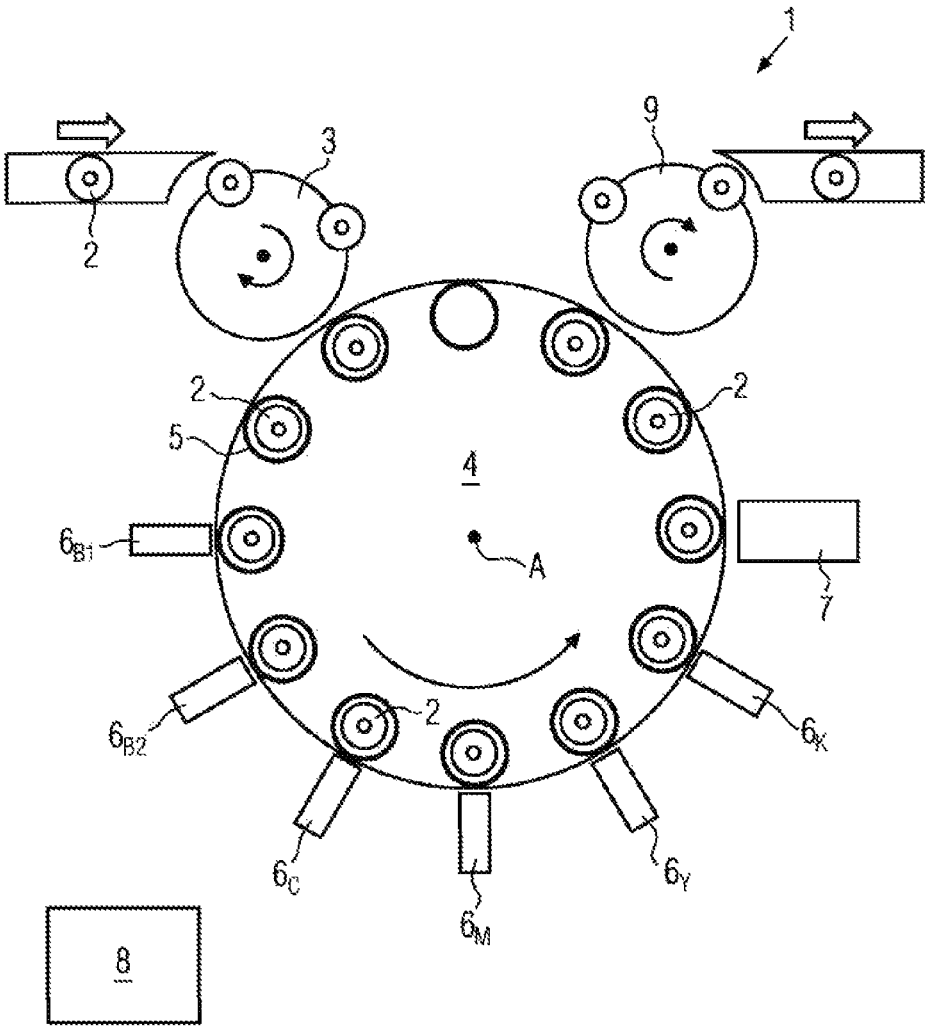
FIG. 5 shows an embodiment of a direct-printing machine according to the present invention in a top view.

FIG. 5 shows an embodiment of a direct-printing machine 1 according to the present invention in a top view.

What can be seen is that the containers 2 are first applied by means of the infeed starwheel 3 to the container holders 5 on the conveyor 4, which is configured as a carousel. The conveyor 4 rotates about the axis A, so as to convey the containers 2 to the individual printing units $\mathbf{6}_{B1}$, $\mathbf{6}_{B2}$, $\mathbf{6}_{C}$, $\mathbf{6}_{M}$, $\mathbf{6}_{Y}$ and $\mathbf{6}_{K}$. It is imaginable that further printing units, e.g. for special colors, are additionally arranged at the conveyor 4. The printing units $\mathbf{6}_{B1}$, $\mathbf{6}_{B2}$, $\mathbf{6}_{C}$, $\mathbf{6}_{M}$, $\mathbf{6}_{Y}$, $\mathbf{6}_{K}$ operate according to the direct-printing method and are each provided with at least one direct-printing head and an ink feed unit (which is here not shown in detail).

There, the containers 2 are printed on by means of one of the printing units $\mathbf{6}_{B1}$, $\mathbf{6}_{B2}$, selectively with a first basic ink or a second basic ink, depending on the type of material. The first and the second basic ink are here configured as a primer and they are compatible with containers 2 of a first type of material and of a second type of material, respectively. Subsequently, the containers 2 are conveyed to the printing units $\mathbf{6}_{C}$, $\mathbf{6}_{M}$, $\mathbf{6}_{Y}$ and $\mathbf{6}_{K}$, where they are printed on with colored inks cyan, magenta, yellow and black in a direct-printing process. In this way, a multi-color direct print is created on the containers 2.

Following this, the containers 2 are moved past the curing station 7 so as to cure the first and the second basic ink, respectively, as well as the colored inks. Alternatively, the curing station may also be arranged separately from the conveyor 4. It is also imaginable that a respective pinning station is arranged between the printing units $\mathbf{6}_{B1}$, $\mathbf{6}_{B2}$, $\mathbf{6}_{C}$, $\mathbf{6}_{M}$, $\mathbf{6}_{Y}$, $\mathbf{6}_{K}$ in order to cure the previously applied printing ink at least partially for the printing of the subsequently applied printing ink. As a result, the printing inks will not run into one another and the quality will be improved.

After the direct print on the containers 2 has been cured, the containers are advanced by the discharge starwheel 9 so as to undergo further treatment steps.

In addition, the control unit 8 can be seen, which controls the direct-printing machine 1 according to the method 100 described above in FIG. 1 and the substeps according to the third variant 400 of FIG. 4. To this end, the control unit 8 is configured as a digital machine control.

The direct-printing machine 1 according to FIG. 5 is used as follows: first, containers 2 of the first type of material are printed on according to the direct-printing method, the first basic ink being here applied first by means of the printing unit $\mathbf{6}_{B1}$ and the colored inks being applied subsequently by means of the printing units $\mathbf{6}_{C}$, $\mathbf{6}_{M}$, $\mathbf{6}_{Y}$, $\mathbf{6}_{K}$. In the case of a change to the containers of the second type of material, it will then suffice to switch over from the printing unit $\mathbf{6}_{B1}$ with the first basic ink to the printing unit $\mathbf{6}_{B2}$ with the second basic ink. As a result, a change to containers of a different type of material will take place particularly quickly.

Figure 6:
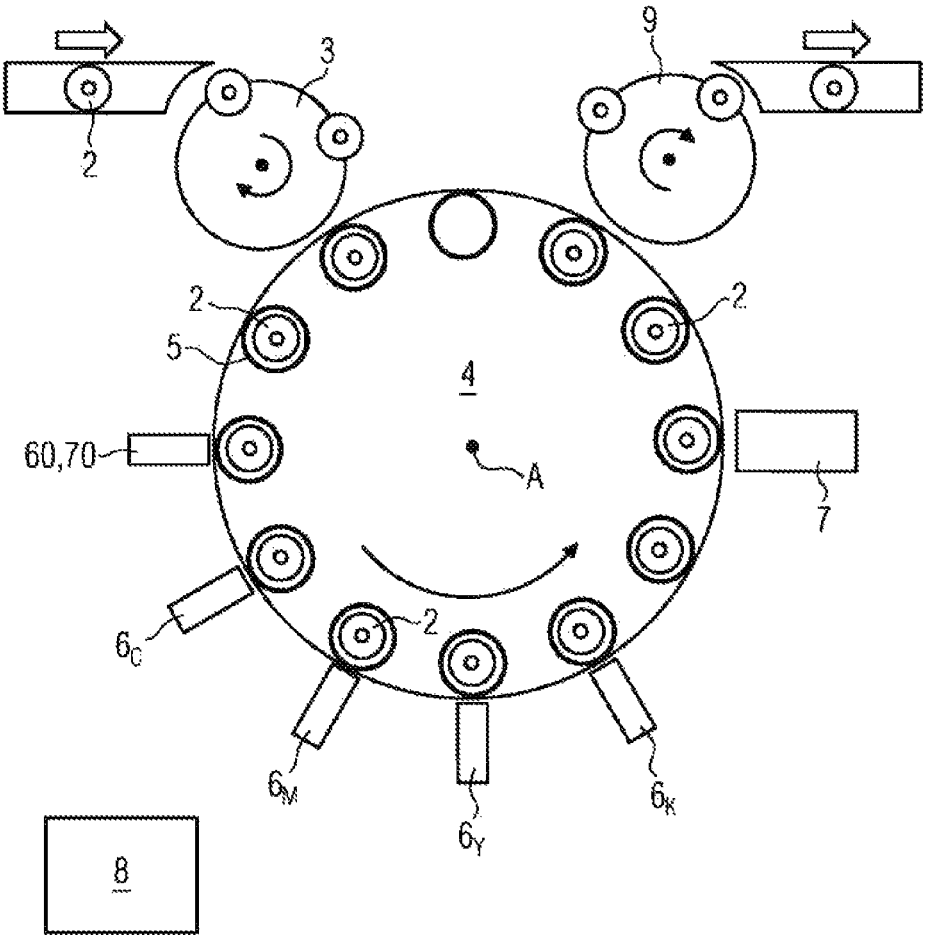
FIG. 6 shows a further embodiment of a direct-printing machine according to the present invention in a top view.

FIG. 6 shows a further embodiment of a direct-printing machine 1 according to the present invention in a top view. This differs from the embodiment according to FIG. 5 essentially insofar as only a single printing unit 60, 70 is here configured, which can be switched over for selectively printing the first or the second basic ink. All the other elements of the direct-printing machine correspond to the above described FIG. 5.

Figure 7A:
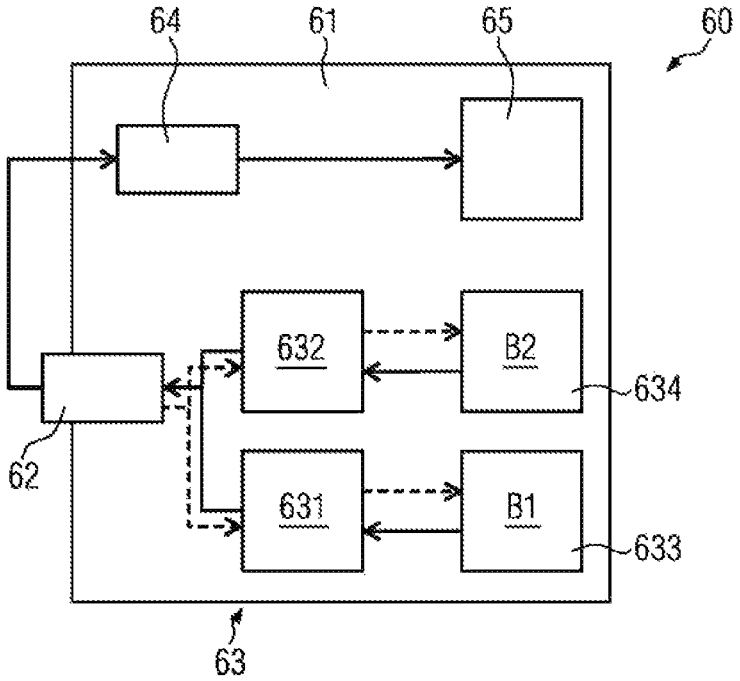
FIG. 7A shows an embodiment of the printing unit according to FIG. 6 in a top view.

The printing units 60, 70 will be explained hereinafter in more detail making reference to FIG. 7A, 7B:

FIG. 7A shows the printing unit 60 that operates according to the substeps 200 in FIG. 2. It can be seen that the ink feed unit 63 comprises a first reservoir 633 with a supply of the first basic ink B1, a first conveying system 631 for the first basic ink, a second reservoir 634 with a supply of the second basic ink B2, a second conveying system 632 for the second basic ink and a direct-printing head 62 which is selectively usable for the first or the second basic ink B1, B2.

In addition, the printing unit 60 comprises the cleaning unit 64 and the waste container 65. Making use of the cleaning unit 64, the first basic ink B1 or the second basic ink B2 can be emptied from the printing unit according to step 202. The cleaning unit 64 comprises e.g. a collecting basin for collecting ink from the direct-printing head 62. Likewise, it is imaginable that the cleaning unit 64 comprises a connection to the ink feed unit 63, into which excess basic ink can be discharged during emptying.

It can also be seen that, according to the dashed arrows, the first and the second basic ink B1, B2 can be pumped from the direct-printing head 62 via the first and second conveying systems 631, 632 back into the reservoirs 633, 634. In this way, the printing ink can be caused to circulate.

The ink feed unit 63 can thus selectively switch to the supply of the direct-printing head 62 with the first basic ink B1 or with the second basic ink B2. By way of example, the direct-printing head 62 is first supplied by the conveying system 631 with the first basic ink from the first reservoir 633.

When changing, the first basic ink B1 is first emptied towards the cleaning unit 64 and into the waste container 65 (step 202). Then, the ink feed unit 63 is switched to the conveying system 632 and the second reservoir 634 with the second basic ink B2. Subsequently, the printing unit is first flushed according to step 204 and then supplied with the second basic ink B2 from the second reservoir 634 according to step 205.

When switching back to the first basic ink B1 takes place, the above steps are executed in reverse order.

Figure 7B:
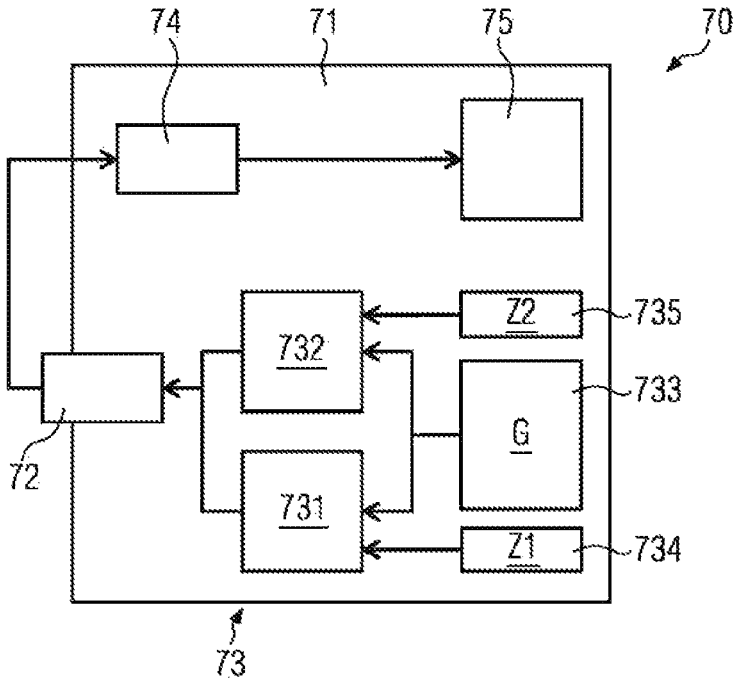
FIG. 7B shows a further embodiment of the printing unit according to FIG. 6 in a top view.

FIG. 7B shows an alternative embodiment of the printing unit 70 according to FIG. 6 in a top view.

The printing unit 70 differs from the embodiment of the printing unit 60 according to FIG. 7A with respect to the ink feed unit 73 essentially insofar as a basic component G from the reservoir 733 is here mixed with the first additive Z1 from reservoir 734 or the additive Z2 from reservoir 735, so as to selectively mix therefrom the first or the second basic ink at the printing unit 70.

It can be seen that the conveying system 731 mixes, for containers of the first type of material, the first basic ink from the basic component G originating from reservoir 733 and the additive Z1 originating from reservoir 734. As a result, the first basic ink is formed and the direct-printing head 72 is supplied therewith.

In a corresponding manner, when a change to containers of the second type of material and the second basic ink takes place, the basic component G is obtained from reservoir 733 by means of the conveying system 732 and has the additive Z2 originating from reservoir 735 admixed thereto.

In the case of a change, a course of action in accordance with the substeps of the second variant 300 according to FIG. 3 is taken. First, the direct-printing head 72 has fed thereto the first basic ink, which is mixed from the basic component G and the additive Z1. Here, containers of the first type of material are printed on with the first basic ink.

When changing to the containers of the second type of material, the first basic ink is first emptied from the printing unit 70 according to step 302 by discharging it, as described above, via the cleaning unit 74 into the waste container 75. Subsequently, the ink feed unit 73 is switched over to the second additive Z2 from the reservoir 735 (step 303) and the printing unit 70 is flushed therewith (step 304). Then, the direct-printing head 72 has fed thereto the second basic ink, which is mixed from the basic component G and the second additive Z2, according to step 305.

By means of the printing units 60, 70 according to FIG. 7A-7B, printing with the first basic ink can be switched over to printing with the second basic ink without major effort.

Due to the fact that, in the above described embodiments, the first and the second basic ink are chemically and physically compatible, it is possible to flush the printing unit 60, 70 with the second basic ink when changing from the first to the second basic ink, and, vice versa, with the first basic ink when changing from the second to the first basic ink. Hence, the printing unit can be switched over without any additional flushing solutions or the like being necessary.

It goes without saying that the features mentioned in the above described embodiments are not limited to these combinations, but can be also be provided individually or in arbitrary other combinations.

The invention claimed is:

1. A method for printing on containers of different types of materials in a direct-printing process, wherein containers of a first type of material are conveyed by means of a conveyor and printed on, in several layers, with a plurality of printing units by means of direct-printing heads with a first basic ink compatible with the first type of material and, on top of the first basic ink, with at least one colored ink, wherein when changing to containers of a second type of material different from the first type of material, the first basic ink is exchanged for a second basic ink, which is compatible with the second type of material, the containers of the second type of material are then printed on, in several layers, with the second basic ink and, on top of the second basic ink, with the at least one colored ink, and the at least one colored ink adheres to the first basic ink and the second basic ink.

2. The method according to claim 1, wherein the second basic ink is chemically and physically compatible with the first basic ink such that both basic inks can be mixed completely into one another, without any destabilization of the two basic inks being caused.

3. The method according to claim 1, wherein one of the printing units is configured for printing the first basic ink and the second basic ink with at least one direct-printing head, and an ink feed unit supplies the at least one direct-printing head selectively with the first basic ink or the second basic ink for purposes of printing.

4. The method according to claim 3, wherein, during a change, the at least one direct-printing head and/or the ink feed unit with the first basic ink are emptied at least partially, and filled with the second basic ink.

5. The method according to claim 4, wherein the direct-printing head and/or the ink feed unit are filled at least once with the second basic ink during flushing, so that the first basic ink remaining therein after emptying mixes with the second basic ink.

6. The method according to claim 4, wherein, the at least one direct-printing head and/or the ink feed unit with the first basic ink are flushed at least once, and wherein during the flushing, the at least one direct-printing head and/or a common supply section for both basic inks are flushed.

7. The method according to claim 4, wherein the at least one direct-printing head and/or the ink feed unit with the first basic ink are flushed at least once.

8. The method according to claim 3, wherein, during printing, the at least one direct-printing head is selectively supplied from a first ink supply with the first basic ink or from a second ink supply with the second basic ink by means of the ink feed unit, and wherein the ink feed unit switches from the first ink supply to the second ink supply during the change.

9. The method according to claim 3, wherein the ink feed unit mixes a basic component selectively with a first additive or a second additive so as to form therefrom either the first basic ink or the second basic ink, and wherein, during the change, the ink feed unit switches over from mixing the basic component with the first additive to mixing the basic component with the second additive.

10. The method according to claim 9, wherein the ink feed unit obtains the basic component, the first additive and the second additive from respective different supplies.

11. The method according to claim 1, wherein, during a change, switching over from one of the printing units for printing the first basic ink to another printing unit for printing the second basic ink, or an exchange of these printing units, is carried out.

12. The method according to claim 1, wherein the first type of material and the second type of material of the containers are different types of plastic material.

13. The method according to claim 1, wherein the first type of material and the second type of material of the containers are different types of plastic material selected from the group consisting of PET, HD-PE and PP.

14. The method according to claim 1, wherein the first type of material and the second type of material of the containers are different types of material selected from the group consisting of glass, plastic, metal, biodegradable materials and hybrid materials.

* * * * *